US005659933A

United States Patent [19]

McWilliams

[11] Patent Number: 5,659,933

[45] Date of Patent: Aug. 26, 1997

[54] ODOR-PROOF SEALABLE CONTAINER FOR BODILY REMAINS

[76] Inventor: Edward L. McWilliams, 7931 Canary Way, San Diego, Calif. 92123

[21] Appl. No.: 625,236

[22] Filed: Apr. 1, 1996

[51] Int. Cl.[6] ..... A61G 1/00

[52] U.S. Cl. ..... 27/28; 27/7; 383/113

[58] Field of Search ..... 27/28, 35, 7; 206/438, 206/524.2; 383/113

[56] References Cited

U.S. PATENT DOCUMENTS

| | | | |
|---|---|---|---|
| 924,029 | 6/1909 | Barnes . | |
| 3,403,064 | 9/1968 | Bellamy | 383/113 X |
| 4,363,841 | 12/1982 | Snow | 383/113 X |
| 4,780,940 | 11/1988 | Jay . | |
| 4,790,051 | 12/1988 | Knight . | |
| 4,924,565 | 5/1990 | Rathjen | 27/7 |
| 5,046,604 | 9/1991 | Forhetz et al. . | |
| 5,150,971 | 9/1992 | Strong et al. | 383/113 X |
| 5,293,756 | 3/1994 | Nelson et al. | 383/113 X |
| 5,341,548 | 8/1994 | Zerick . | |

*Primary Examiner*—Kien T. Nguyen

*Attorney, Agent, or Firm*—Brown, Martin, Haller & McClain

[57] ABSTRACT

Containers are described for retention of human or animal remains for extended periods. The bags are constructed of laminated materials and sealed, which prevents the escape of noxious or odorous decomposition gases or harmful decomposition fluids into the ambient surroundings. The invention also provides for infusion or extraction of gases to retard the decomposition of the contained remains. The container is constructed of flexible multilayer laminated walls forming an interior chamber for accommodation of remains, and after the remains are emplaced the container's opening is sealed. The multilayer laminate includes at least two layers of polymeric sheet material with a metal foil layer between them, although use of more complex polymer/metal laminates is also described. The polymeric layer materials include polyolefin, nylon or polyvinyl sheet materials and the metal foils are normally aluminum foil. The containers may be furnished flat to the end user and joined in series coiled into large rolls from which the user merely cuts off desired lengths as needed. The roll structure and sealing method may also be used with other types of containment bags.

24 Claims, 1 Drawing Sheet

ODOR-PROOF SEALABLE CONTAINER FOR BODILY REMAINS

BACKGROUND OF THE INVENTION

1. Field of the Invention

The invention herein relates to containers for human or animal remains. More particularly, it relates to containers in which remains may be stored for a substantial period of time.

2. Description of the Prior Art

In many cases when a person has died, it is necessary to store the body for some extended period of time (i.e., for a period of days or weeks). For instance, if the dead person is suspected to have succumbed as a result of a crime, an autopsy will usually be performed to determine or confirm the cause of death. In many cases, however, it is also necessary to retain the body after the autopsy so that subsequent tests and examinations related to the criminal investigation can be performed. Similarly, when a person has died from unknown causes and an autopsy is performed, the results take some days or weeks to be returned from laboratory analysis. The remains must be retained during that period, for if the initial laboratory samples are lost or contaminated, or if the analyses prove inconclusive, it is will normally usually be necessary to obtain additional samples for analysis.

It is also common to save bodies to be used as cadavers for medical school education.

It is also frequently necessary to save the remains of animals. Frequently when an animal, particularly a farm, pet or food animal, dies of unknown causes, it is necessary for veterinarians to examine the body to determine the cause of death, so that if the cause is a communicable disease, its spread can be prevented. Also, when an animal, particularly a wild animal, has attacked and bitten a person and the animal has subsequently been killed, its remains will be analyzed for transmittable diseases, especially (for some species) rabies. As with examination of human remains, it will be necessary to store the animal remains for varying periods of time until all testing and examination have been completed.

Further, in many cases where the entire body of the person or animal is not retained, there is still a need to retain specific organs, tissue samples and the like for subsequent examination or analysis. The same problems of deterioration, odor and so forth pertain to such retained organs and samples as to an entire body.

There are many simple body bags in use for temporary storage of remains prior to burial or cremation. As an example, most common body bags used by hospitals, medical examiners or coroners are bags made of cloth, canvas or plastic sheeting. Most such bags are made in standard sizes for ease of inventorying, since a medical examiner or hospital must keep a supply of various sized bags to accommodate the remains of adults and children of correspondingly various heights and weights. Commonly such bags have a zipper or rib-in-groove closure (comparable to a ZipLock™ closure) running the axial length of the bag. This permits the body to be easily inserted into the bag and the bag closed with a minimum of difficulty. This type of bag also allows routine inspection of remains, such as for identification of an accident or crime victim by the next of kin.

Such bags are usually made of simple materials, such a single layer of cloth, canvas or polymeric film, and are permeable to both gases and liquids exuded from the remains. Also, such bags do not by themselves provide for more than short term retention of remains (such as for transport between an accident or crime site and a morgue). Where it is necessary to retain a body for more than just a few hours, the common practice is to place the body, still in the original body bag, into a refrigerated compartment, usually at a hospital, a municipal morgue, or similar facility. Such refrigeration slows decomposition of the remains but does not halt it. Thus, hospital or morgue workers or others who must be in the vicinity of the body, such as to inspect, analyze or obtain samples, find such presence and such tasks increasingly difficult, onerous and, in fact, dangerous as time passes and the body further deteriorates. Of particular concern are the noxious odors which decomposing remains generate when in the presence of oxygen. Not only are some of the gaseous decomposition products harmful to those breathing them, but almost all have noxious odors which can make nearby persons nauseous and, at the very least, limit the amount of time that such persons can or are willing to be in the presence of the body.

In the past, there have been a number of configurations of specialized body bags and other similar containers patented or described in the literature. Most often, these have been containers designed for transport of a body to a distant location for examination or burial, or have been containers intended to permit exhibit of a body as for viewing before or during funeral ceremonies. Other containers have been intended for emergency disaster use when it is anticipated that there will be large numbers of fatalities and the bodies must be rapidly collected and stored until proper burial can be arranged. A typical example of the latter type of bag is that disclosed in U.S. Pat. No. 4,790,051 which describes a vinyl "pouch" having a two-part openable body access panel composed of inner and outer sheets. The outer sheet has a zipper and the inner sheet has a rib-and-groove fastener. The container is described as being odorless, flexible and waterproof.

Most of the types of bags described have proved to be cumbersome or not entirely satisfactory. Many transportation bags, for instance, are made of cumbersome heavy material intended to withstand the rigors of handling and shipment. On the other hand, lighter bags, even those often labeled "odor-proof," are usually made of thin polymeric sheet materials which do little to retard the escape of noxious decomposition gases from a bag. Thus, simple zipper-closured containers or rib-and-groove-closured containers constructed of plastic sheets (such as vinyl sheets) have not proved to be satisfactory for extended storage of remains because they permit escape of odors, notwithstanding the claims made for them.

SUMMARY OF THE INVENTION

The invention described herein avoids and overcomes the deficiencies and limitations of the prior art containers or bags. The present container is a bag for long term containment of human or animal remains which will in fact prevent the escape of odorous decomposition gases or harmful decomposition fluids into the ambient surroundings from such remains over extended periods of time, with or without refrigeration of the remains. The invention also provides for infusion or extraction of gases, to retard the decomposition of contained remains.

In a broad embodiment, the present invention is of a container for bodily remains which comprises flexible walls defining and enclosing an interior chamber of dimensions sufficient to accommodate the remains; a closable opening in the walls providing access to the interior chamber for placing the remains therein; the walls comprising a multilayer laminate comprising two layers of polymeric sheet material having adhered therebetween and coextensive therewith a layer of metal foil, the walls being impervious to gas and liquid; whereby when the remains are placed in the interior chamber and the opening is closed, gases and fluids generated by the remains are contained within the chamber and do not exude through the walls for an extended period of time.

In another embodiment, the invention includes a such a container wherein the walls comprise at least three the polymeric layers with at least two interleaved metal foil layers.

The polymeric layers normally will be layers of polyolefin, nylon or polyvinyl sheet materials, particularly polyolefin materials such as polyethylene or polypropylene, although other polymeric sheet materials with equivalent properties may also be used. The metal foil will normally be aluminum foil, because of its ready availability and reasonable cost, although other metal foils with equivalent properties may also be used. Optionally one may also include other types of sheet materials with which the polymeric and metal layers will bond suitably; as an example, one may include layers of paper, especially kraft paper. All layers will be bonded into the laminate over their entire surface extent to form the materials for use in fabricating the containers of this invention.

The containers are preferably generally tubular in shape when open, may be of any convenient cross section (which will be variable since the wall materials are flexible), and will have a closable, sealable opening at one end, and preferably one at each end, simplifying insertion of the remains into the container. The open ends are readily closable and are commonly sealed by heat sealing or adhesives. The tubular containers can also be furnished in a flattened configuration to the end user, and joined together at their respective ends, which permits them to be coiled into large rolls from which the user merely cuts off desired lengths as needed and forms the individual bags.

The roll structure is also useful for dispensing other types of containment bags, and the heat or adhesive sealing method can be used on such bags formed by severing from the elongated roll. Such bags can be used for temporary short-term retention of bodily remains.

Other advantages and variations of the invention will be disclosed below.

DETAILED DESCRIPTION AND PREFERRED EMBODIMENTS

Figure 1:
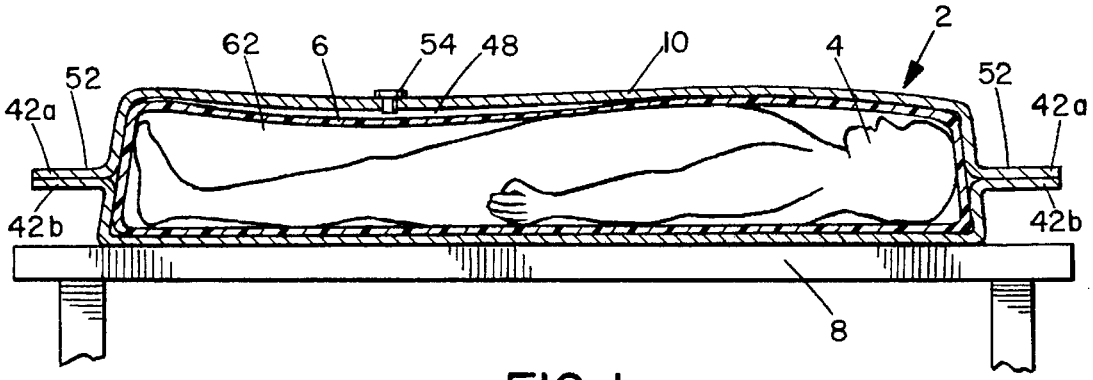
FIG. 1 is a side elevation view, partially in section, illustrating a body bag of the present invention in use and containing a human body.

The invention is best understood by reference to the drawings. In FIG. 1, a container of the present invention is shown in one of its principal intended uses. In this illustration the bag does not contain the body directly, but rather encloses and contains both the body and the simple body bag used for the original collection and transport of the body. In FIG. 1 the container of the present invention (which will also be referred to herein as a "bag") is designated 2 while the conventional initial body bag housing the body 4 is designated 6. The two bags 2 and 6 and the contained body 4 are illustrated as resting on a table 8, although of course the assemblage could be supported by any convenient apparatus of sufficient size, such as a refrigeration drawer or shelf, a gurney, an autopsy or examination table, and the like.

Figure 2:
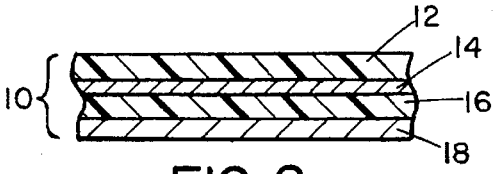

The bag 2 of the present invention obtains its unique non-permeability properties by being formed of laminated walls which are composed of interleaved layers of polymeric film and metal foil. FIG. 2 illustrates a cross-section of a typical bag wall structure in one of its broadest and most basic forms. The wall 10 of the bag 2 in FIG. 2 is made of a basic laminate having an inner layer 12 of polymeric film, a central layer 14 formed of metal foil, and an outer layer 16 also of polymeric film. In the embodiment shown in FIG. 2 there is also an optional layer 18 of a kraft paper adhered to the outside of layer 16. The last layer 18 is optional and an entirely suitable bag can be formed of the laminated layers of polymeric sheets and metal foil. These layers are adhered together over their entire abutting surfaces by conventional adhesives used for securing polymer sheets to metal foil sheets. There are many such adhesives commercially available and the basic types have been described for many years: see, e.g., Rubin (ed.), *Handbook of Plastic Materials and Technology*, ch. 117 (1990); *Modern Plastics*, vol. 64, no. 10A [1987–1988 *Encyclopedia*], p. 370 (October, 1987); and Modern Plastics, vol. 49, no. 10A [1972–1973 *Encyclopedia*], pp. 680–681 (October, 1972). Adhesives may be primarily physical in nature, in that the adhesive forms a physical layer between the two surfaces to be joined, and adheres separately to each of them to form the sealed bond, or may be primarily chemical in nature, in that the adhesive partially dissolves or otherwise modifies the opposed surfaces of the surfaces so that they adhere directly to each other. Other adhesives are of a hybrid nature, in that they not only modify the opposed surfaces to permit direct bonding to some extent, but they also adhere to the surfaces themselves and participate in the bond.

Any suitable polymeric sheet material may be used, although those preferred will be the polyolefins (especially polyethylene and polypropylene), nylon, vinyl polymers, and others with like properties and the ability to be laminated with metal foils and bonded to each other for bag sealing. It is critical to the present invention that the polymeric sheet materials be used as the inner and outer layers with the metal foils being used between the polymeric films. As will be illustrated below, there may be any number of layers in the laminated walls, limited only by flexibility and weight (and for most applications, also by cost). All polymeric layers may be of the same polymeric material, or different layers may be of different polymers. Similarly, different types of metal foils may be used, but because of cost, flexibility and availability it will be common for the foil to be aluminum foil. The polymeric films and metal foils will be of various individual weights and thicknesses, depending on how many layers are used in the laminate. However, an overall thickness in the range of about 5–15 mils (0.13–0.38 mm) is preferred for the laminate, with and overall tensile strength in the range of approximately 4000–5500 lb/in$^2$ (27–38 kPa).

Figure 3:
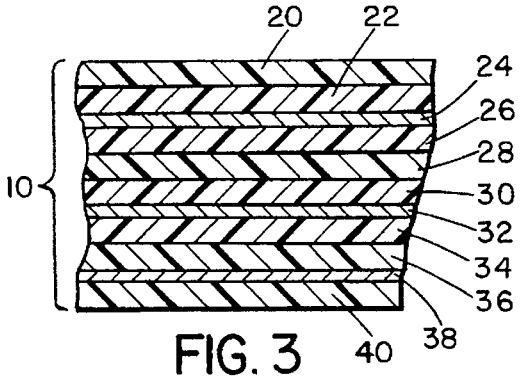
FIGS. 2 and 3 are schematic views illustrating the laminated structure of the container walls in two different embodiments of the containers of this invention.

As examples of suitable materials, a commercial laminate of the type illustrated in FIG. 2 is a product designated "Foil Pak #6" from Bell Fibre Products Corp. of Columbus, Ga. This product is composed of layers of polyethylene, aluminum foil, polyethylene and kraft paper, and meets military specification MIL-B-131, Type 1, Class 2. As noted, more complex laminates may also be used, such as illustrated in FIG. 3, in which there is a multilayer laminate 10 composed of, successively, layers 20 and 22 of polyolefin films, layer 24 of metal foil, layer 26 of polyolefin, layer 28 of nylon, and then layers 30, 34, 36 and 40 of polyolefins interweaved with layers 32 and 38 of metal foil. A commercial example of such a laminate, also from Bell Fibre Products Corp., is one designated "FR 2185" and composed of, successively, layers of polypropylene (layer 20), polyethylene (22), metal foil (24), polyethylene (26), nylon film (28), polyethylene (30), metal foil (32), "Tyvek"™ polyethylene (34), polyethylene (36), aluminum foil (38) and polyethylene (40). This product meets military specification MIL-B-131, Type 1, Class 1. All of these types of bag wall materials are strong as well as being impervious to liquids and gases.

Figure 4:
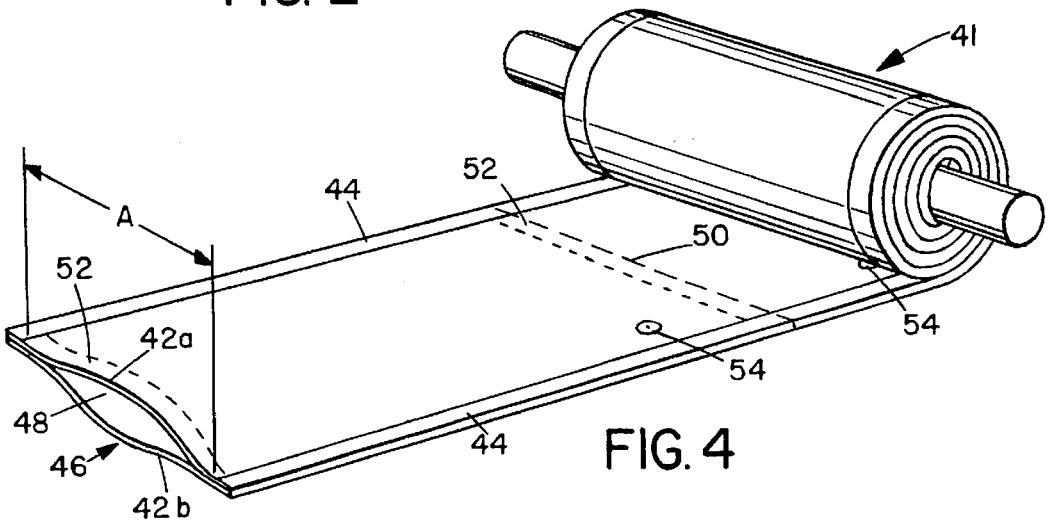
FIG. 4 is a perspective view illustrating a roll of joined containers of the present invention, from which bags of the appropriate length may be separated as needed.

A particularly useful form in which the bags 2 can be provided is illustrated in FIG. 4. A large roll 41 contains a series of "bag precursors" which are essentially bags 2 open at each end to form a tubular configuration and joined together end-to-end. The bags are formed by joining two identical sheets 42*a* and 42*b* to form opposed walls 10. The sheets 42*a* and 42*b* are bonded together to form the elongated tube shape by heat or adhesive sealing along their peripheral lateral edges in the areas indicated as 44. The central lateral dimension A between the bonded areas 44 is sufficiently large to allow the bag to be opened widely as indicated schematically at 46 so that the body 4, usually contained in the initial body bag 6, can be easily inserted into the interior 48 of the bag 2. Thus, when a morgue or hospital technician wishes to the use the bag 2 to enclose a newly received body 4, he or she will first determine the appropriate length of bag 2 needed to completely enclose the body 4 (and usually also the original body bag 6) and leave sufficient excess material at the ends for subsequent closure, as will be described below. The technician then measures off that length of material from the roll 41 and cuts that length off of the roll at the appropriate point, exemplified in this case by the location of the dotted line 50 in FIG. 4. The technician thus now has an elongated tubular container, the precursor of the bag 2, which is open at both ends. The technician then slides the body bag 6 containing the body 4 into the interior 48 of the tubular precursor until the bag 6 is completely inside with the excess material extending at both ends. With the tubular precursor at this point still being open at both ends, the insertion of the body 4 (and bag 6) is made simpler if two technicians work in cooperation and grasp opposite ends of the bag 6 to move the bag 6 the tubular container interior 48.

Once the body 4 and bag 6 are in place, laminated sheets 42*a* and 42*b* at each open end are pulled together and brought into alignment as shown in FIG. 1, forming peripheral areas 52 at the longitudinal ends of the bag where the laminates 42*a* and 42*b* are pressed together. The peripheral areas 52 at the longitudinal ends of the bag 6 correspond to the lateral peripheral areas 44 which have previously been joined together as by heat or adhesive sealing. In a similar manner the areas 52 are then bonded and sealed as by heat or adhesive, so that sheets 42*a* and 42*b* are adhered completely across the bag in the areas 52, as indicated in FIG. 4, so that the openings 46 are completely closed. The bag 2 is then completely formed and sealed with the body 4 (and bag 6) enclosed inside. The perimeter areas 44 and 52 are preferably bonded together over a relatively wide area (usually being the outer 2–4 in [50–100 mm] of the edges of the laminates 42*a* and 42*b*).

The roll structure and the sealing method described in conjunction with FIG. 4 are not limited solely to body bags of laminated structure, but rather can be used with any body bag. Thus a morgue employee may, for instance, use the roll structure and sealing method merely as part of the transfer of a body from one temporary containment bag to another where the first bag has become torn or otherwise unsuitable for further use.

The bags of this invention do not include openable closures controlled by "access devices" such as zippers or rib-in-groove fasteners. The bag must be completely sealed to insure entrapment of all decomposition gases and liquids. These fluids (and their odors) cannot pass through the laminated impervious walls 10. However, if such access devices were present, there would be some degree of fluid permeability, especially of decomposition gases, since it has been found that when prior art bags have contained such access devices, fluid (and odor) impermeability is not possible to attain.

The body 4 can be maintained within the bag 2 for extended periods of time either with or without refrigeration, and such periods can be further extended if the ambient air initially within the bag 2 (and bag 6) is exchanged for an inert gas, as will be discussed below. Further, while decomposition of body 4 will continue for a period of time, the fact that the walls 10 are impervious to gases means that as decomposition consumes the oxygen initially within the bag, the decomposition will slow progressively as less and less oxygen remains available for the decomposition reactions. This effect is enhanced if the technician mechanically forces a significant amount of the initial air out of the bag 6 prior to the final sealing of the perimeter areas 52.

In the description above, the system has been described with the body 4 remaining within the original body bag 6. It is possible however (although not preferred), for the body 4 itself to be placed directly into the bag 2 and then the bag 2 to be sealed. Thus, the body 4 may be removed from the bag 6 before being put into the bag 2, if desired. For ease of handling of the body 4, however, continued use of the bag 6 is preferred. The fact that the bag 6 itself is unlikely to have much ability to retard the evolution of decomposition gases becomes of no consequence, since the gases will still be retained within the interior space 48 of the bag 2.

In another embodiment of the bag of the present invention, the bag 2 is formed with one or more self-sealing valves 54 incorporated into the bag. In the roll embodiment shown in FIG. 4, such valves 54 can be incorporated at regular or irregular intervals along the length of the rolled material so that as the various lengths are cut off for individual bags, each bag 2 will contain at least one valve 54 and may contain more than one. For the most part, however, one valve per bag will be satisfactory. The inclusion of additional valves is less preferred because of the increased possibility of leakage through a defective valve. It will be evident that these valves 54 are not functional equivalents of the "access devices" prohibited above, since the valves 54 are self-sealing and are not fluid permeable other than by use of a device such as the needle valve discussed below.

Figure 5:
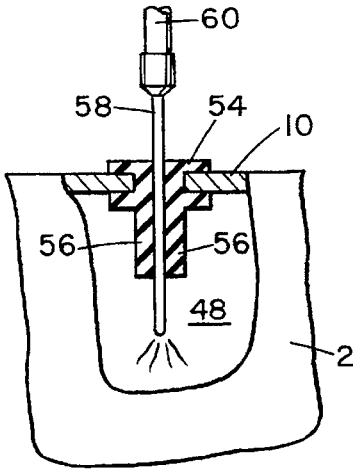
FIG. 5 is a cross-sectional detail view, partly in section, illustrating a valve incorporated into the bag for extraction or insertion of gases to or from the bag.

A typical valve 54 is shown schematically in FIG. 5. The valve 54 is preferably of the type commonly used to permit inflation of such devices as air mattresses or floats or sports equipment such as footballs and basketballs. The valve 54 is a self-sealing valve which includes two opposed abutting flaps 56 which can be separated by insertion of a hollow needle valve 58, but which upon removal of the needle valve 58 are forced by the gas pressure within the interior 48 of the bag to be pressed together and thus seal against subsequent escape of any of the gas from inside the bag.

In a preferred method of use of the bags 2, it is contemplated that as shown in FIG. 5 a technician will insert a needle valve 58 through the valve 54. The needle valve 58 is connected to gas conduit 60 to a exhaust pump (not shown) which exhausts air and decomposition gases from the interior 48 of the bag. In this regard, it is often helpful to have the regular body bag 6 opened to some extent, by opening the zipper or rib-and-groove closure with which such bags are normally equipped. The exhaust pump will then exhaust air and gas not only from the interior 48 of the bag 2, but also from the interior 62 of bag 6. Once a significant amount of air and gas has been exhausted, which is normally determined by the capacity of the exhaust pump and the length of time for which the pump is run, the needle valve 58 can be withdrawn from the valve 54 and the bag 2 left in its partially exhausted configuration. This is a useable configuration, but one that is less preferred, since the differential between the reduced gas pressure inside the bag and the ambient air pressure outside will tend to force ambient air through valve 54 into the interior 48 of the bag and interior 62 of bag 6, and may thus gradually replenish the oxygen supply within the bag 2 and contribute to accelerated decomposition of the body 4.

It is more preferred, therefore, that after the desired degree of gas removal from the bag 2 has been completed, the conduit 60 and needle valve 58 are used to inject an inert gas such as nitrogen or argon into the interiors 48 and 62 of the bags to surround the body with inert gas which does not support decomposition. The gas injection may be by use of the same pump (now run as a supply pump rather than as an exhaust pump) or from a pressurized tank of the inert gas. The tissues of the body 4, then not having access to air or other oxygen-containing gas, will have their decomposition rate greatly diminished and, in many cases, essentially completely halted. Of course to the extent that some oxygen remains, either as residual air or trapped within the body, or oxygen from the body fluids themselves, some decomposition will continue, although at a greatly reduced rate reflecting the limited amount of oxygen remaining. Once the bags have been filled to the desired degree with the inert gas, the needle valve 58 can be removed and the valve 54 will seal. Usually the inert gas will be injected to a final pressure slightly above the ambient atmospheric pressure so that the valves 54 will tend to remain closed and the differential between the greater interior pressure and the lesser ambient pressure will prevent ambient air from entering the valve 54.

Since the bag 2 is sealed around its entire perimeter, there will be no ability for anyone to have access the interior of the bag for inspection of the body 4 other than by cutting open the bag. This is intended, since the bag's purpose is long term storage of the body, until such time as inspection or analysis is to be done. Once the bag 2 has been cut open, it may be discarded and a new bag 2 cut from the roll 41 and resealed around the body 4 when the testing or inspection has been completed. Alternatively, the bag may be reused, and after the body 4 has been replaced within the bag 2, the bar may be resealed as by adhering a narrow elongated strip of the bag wall laminate over the cut slit, or by overlapping the edges of the slit with each other and heat sealing the overlapped edges to seal the slit.

Because of the multilayer laminate construction of the bag walls 10 and the complete peripheral sealing of the bag at 44 and 52, the bags of the present invention have been found to permit long term storage of bodies without any escape of odor, gas, body fluid or other noxious material, thus making storage and handling of bagged bodies simple and tolerable for the hospital or morgue technicians or other persons who must be in the vicinity of the stored bodies. As an example, bags of the present invention formed from the aforesaid "Foil Pak #6" material were fabricated and provided for testing purposes to the Medical Examiner's Office of San Diego County, California. The personnel at the Medical Examiner's Office used the bags in the manner described above for extended term storage of a number of human bodies received at the morgue in the normal course of daily routine. The bags were found to be useful and unique and were recognized as being extremely valuable for preserving bodies without having noxious or hazardous odors or spillage of body fluids as environmental hazards. Particularly cited as useful by the Medical Examiner's personnel was provision of the bags 6 in rolls 41 as indicated in FIG. 4 from which the personnel could cut bags to size as needed, depending on the size of the body; different sizes were used, for instance, for bodies of adults or children.

Similarly, if the bags were used in an animal environment, as by a veterinarian or animal control technician, different bags could be cut to size depending on whether the remains were of large or small animals.

It will be evident that there are numerous embodiments of this invention which, while not expressly described above, are clearly within the scope and spirit of the invention. The above description is therefore intended to be exemplary only and the invention is to be limited solely by the appended claims.

I claim:

1. A container for bodily remains which comprises:

a plurality of flexible walls defining and enclosing an interior chamber of dimensions sufficient to accommodate said remains;

a closable opening formed by said walls providing access to said interior chamber for placing said remains therein;

said walls comprising a multilayer laminate comprising two layers of polymeric sheet material having adhered therebetween and coextensive therewith a layer of metal foil, being impervious to gas and liquid, and having a peripheral edge with a peripheral area adjacent thereto:

the peripheral areas of adjacent walls aligned with and sealed to each other, such sealing cumulatively extending to enclose said chamber except at said closable opening;

whereby when said remains are placed in said interior chamber and said opening is closed, gases and fluids generated by said remains are contained within said chamber and do not exude through said walls for an extended period of time.

2. A container as in claim 1 further comprising a openable and closable valve in said walls providing gaseous communication therethrough, whereby gas can be extracted from or injected into said chamber.

3. A container as in claim 2 wherein said valve accommodates a thin needle conduit for extraction or injection of gas and is self-sealing when said needle conduit is withdrawn from said valve, thereby preventing further transfer of gas across said walls.

4. A container as in claim 1 wherein there are a plurality of said closable openings.

5. A container as in claim 4 wherein said container is elongated in one dimension and there are two said closable openings, one at each end of said elongated dimension of said container.

6. A container as in claim 5 wherein said elongated container has a generally tubular configuration with said closable openings at the axial ends thereof.

7. A container as in claim 1 wherein said walls comprise at least three said polymeric layers and at least two metal foil layers interleaved thereamong.

8. A container as in claim 1 wherein said polymeric layers comprise layers of polyolefin, nylon, polyvinyl or equivalent polymeric sheet materials.

9. A container as in claim 8 wherein said polyolefin materials comprise polyethylene or polypropylene.

10. A container as in claim 1 wherein said metal foil comprises aluminum foil.

11. A container as in claim 1 wherein said laminate further comprises a layer of paper.

12. A container as in claim 11 wherein said paper comprises kraft paper.

13. A container as in claim 1 of a size commensurate with the accommodation of human remains said chamber.

14. A container as in claim 1 of a size commensurate with the accommodation of animal remains within said chamber.

15. A plurality of said containers as in claim 1 in elongated configuration and joined at the respective ends thereof to form a continuous series of said containers.

16. A plurality of containers as in claim 15 coiled into a roll configuration, whereby individual containers can be separated seriatim therefrom.

17. A container formed by being severed from one end of said roll configuration of claim 16.

18. A container as in claim 1 wherein said peripheral areas and said closable opening are sealable by heat sealing or chemical adhesion.

19. A container as in claim 18 comprising a plurality of said closable openings, each of which is sealable by heat sealing or chemical adhesion.

20. A container as in claim 1 wherein said closable opening is permanently sealed upon closure.

21. A container for bodily remains which comprises:

a plurality of flexible walls defining and enclosing an interior chamber of dimensions sufficient to accommodate said remains;

a closable opening formed by said walls providing access to said interior chamber for placing said remains therein;

each of said walls comprising sheet material impervious to gas and liquid, said material being capable of having individual portions thereof adhered to each other in a liquid- and gas-tight bond, at least some of such individual portions comprising aligned peripheral areas of adjacent walls, and such liquid- and gas-tight bonding cumulatively extending to enclose said chamber except at said closable opening;

whereby when said remains are placed in said interior chamber and said opening is closed by liquid- and gas-tight bonding of other portions of said material surrounding said opening, gases and fluids generated by said remains are contained within said chamber and do not exude through said walls for an extended period of time.

22. A container as in claim 21 wherein said adhered bond comprises a heat sealed bond.

23. A container as in claim 21 wherein said adhered bond comprises a chemically adhered bond.

24. A container as in claim 21 wherein said container comprises a segment of an extended tubular body, said segment being formed by being severed from one end of said body.

* * * * *

UNITED STATES PATENT AND TRADEMARK OFFICE

CERTIFICATE OF CORRECTION

PATENT NO. : 5,659,933

DATED : August 26, 1997

INVENTOR(S) : EDWARD L. MCWILLIAMS

It is certified that error appears in the above-indentified patent and that said Letters Patent is hereby corrected as shown below:

COLUMN 9, CLAIM 13, LINE 19, AFTER "REMAINS" INSERT

--WITHIN--.

Signed and Sealed this

Seventh Day of April, 1998

Bruce Lehman

*Attest:*

BRUCE LEHMAN

*Attesting Officer*

*Commissioner of Patents and Trademarks*

US005659933C1

(12) EX PARTE REEXAMINATION CERTIFICATE (5344th)

United States Patent

McWilliams

(10) Number: US 5,659,933 C1

(45) Certificate Issued: Apr. 18, 2006

(54) ODOR-PROOF SEALABLE CONTAINER FOR BODILY REMAINS

(75) Inventor: Edward L. McWilliams, 7931 Canary Way, San Diego, CA (US) 92123

(73) Assignee: Edward L. McWilliams, San Diego, CA (US)

Reexamination Request:
No. 90/006,397, Oct. 9, 2002

Reexamination Certificate for:

| | |
|---|---|
| Patent No.: | **5,659,933** |
| Issued: | **Aug. 26, 1997** |
| Appl. No.: | **08/625,236** |
| Filed: | **Apr. 1, 1996** |

Certificate of Correction issued Apr. 7, 1998.

(51) Int. Cl.
*A61G 1/00* (2006.01)

(52) U.S. Cl. ..... 27/28; 27/7; 383/113

(58) Field of Classification Search ..... 27/28, 27/35, 7; 383/113; 206/438, 524.2
See application file for complete search history.

(56) References Cited

U.S. PATENT DOCUMENTS 4,076,121 A * 2/1978 Clayton et al. ..... 206/390
4,096,309 A 6/1978 Stillman
4,922,590 A 5/1990 Yearsley

* cited by examiner

*Primary Examiner*—William L. Miller

(57) ABSTRACT

Containers are described for retention of human or animal remains for extended periods. The bags are constructed of laminated materials and sealed, which prevents the escape of noxious or odorous decomposition gases or harmful decomposition fluids into the ambient surroundings. The invention also provides for infusion or extraction of gases to retard the decomposition of the contained remains. The container is constructed of flexible multilayer laminated walls forming an interior chamber for accommodation of remains, and after the remains are emplaced the container's opening is sealed. The multilayer laminate includes at least two layers of polymeric sheet material with a metal foil layer between them, although use of more complex polymer/metal laminates is also described. The polymeric layer materials include polyolefin, nylon or polyvinyl sheet materials and the metal foils are normally aluminum foil. The containers may be furnished flat to the end user and joined in series coiled into large rolls from which the user merely cuts off desired lengths as needed. The roll structure and sealing method may also be used with other types of containment bags.

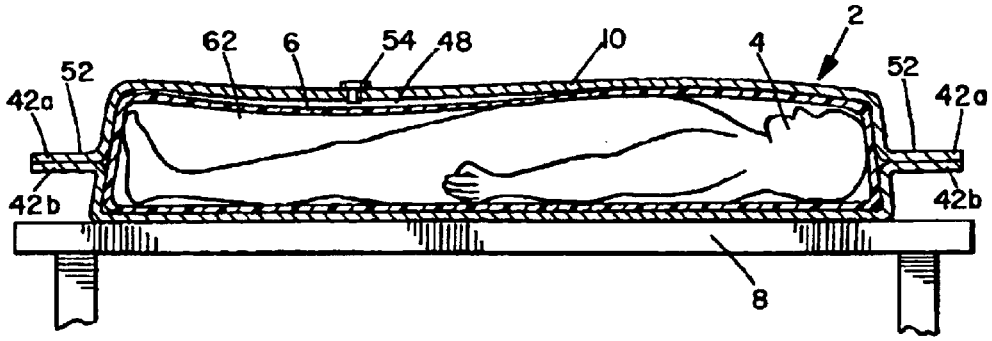

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1–24 are cancelled.

New claims 25–45 are added and determined to be patentable.

*25. A method for containing bodily remains which comprises:*

*providing a container, the container comprising:*

*a plurality of flexible walls defining and enclosing an interior chamber of dimensions sufficient to accommodate said remains;*

*a closable opening formed by said walls providing access to said interior chamber for placing said remains therein;*

*said walls comprising a multilayer laminate comprising two layers of polymeric sheet material having adhered therebetween and coextensive therewith a layer of metal foil, being impervious to gas and liquid, and having a peripheral edge with a peripheral area adjacent thereto:*

*the peripheral areas of adjacent walls aligned with and sealed to each other, such sealing cumulatively extending to enclose said chamber except at said closable opening;*

*placing said remains in said interior chamber and closing said opening, whereby gases and fluids generated by said remains are contained within said chamber and do not exude through said walls for an extended period of time.*

*26. A method as in claim 25 wherein there are a plurality of said closable openings.*

*27. A method as in claim 26 wherein said container is elongated in one dimension and there are two said closable openings, one at each end of said elongated dimension of said container.*

*28. A method as in claim 27 wherein said elongated container has a generally tubular configuration with said closable openings at the axial ends thereof.*

*29. A method as in claim 25 wherein said walls comprise at least three said polymeric layers and at least two metal foil layers interleaved thereamong.*

*30. A method as in claim 25 wherein said polymeric layers comprise layers of polyolefin, nylon, polyvinyl or equivalent polymeric sheet materials.*

*31. A method as in claim 30 wherein said polyolefin materials comprise polyethylene or polypropylene.*

*32. A method as in claim 25 wherein said metal foil comprises aluminum foil.*

*33. A method as in claim 25, the container being of a size commensurate with the accommodation of human remains within said chamber.*

*34. A method as in claim 25, the container being of a size commensurate with the accommodation of animal remains within said chamber.*

*35. A method as in claim 25 wherein said peripheral areas and said closable opening are sealed by heat sealing or chemical adhesion.*

*36. A method as in claim 35, the container comprising a plurality of said closable openings, each of which is sealed by heat sealing or chemical adhesion.*

*37. A method as in claim 25 wherein said closable opening is permanently sealed upon closure.*

*38. A method as in claim 25, the container further comprising a openable and closable valve in said walls providing gaseous communication therethrough, whereby gas can be extracted from or injected into said chamber.*

*39. A method as in claim 38 wherein said valve accommodates a thin needle conduit for extraction or injection of gas and is self-sealing when said needle conduit is withdrawn from said valve, thereby preventing further transfer of gas across said walls.*

*40. A method as in claim 25 wherein said laminate further comprises a layer of paper.*

*41. A method as in claim 40 wherein said paper comprises kraft paper.*

*42. A method for containing bodily remains which comprises:*

*providing a container, the container comprising:*

*a plurality of flexible walls defining and enclosing an interior chamber of dimensions sufficient to accommodate said remains;*

*a closable opening formed by said walls providing access to said interior chamber for placing said remains therein;*

*each of said walls comprising sheet material impervious to gas and liquid, said material being capable of having individual portions thereof adhered to each other in a liquid- and gas-tight bond, at least some of such individual portions comprising aligned peripheral areas of adjacent walls, and such liquid- and gas-tight bonding cumulatively extending to enclose said chamber except at said closable opening;*

*placing said remains in said interior chamber and closing said opening by liquid- and gas-tight bonding of other portions of said material surrounding said opening, whereby gases and fluids generated by said remains are contained within said chamber and do not exude through said walls for an extended period of time.*

*43. A method as in claim 42 wherein said adhered bond comprises a heat sealed bond.*

*44. A method as in claim 42 wherein said adhered bond comprises a chemically adhered bond.*

*45. A method as in claim 42 wherein said container comprises a segment of an extended tubular body, said segment being formed by being severed from one end of said body.*

* * * * *